US008011471B2

(12) United States Patent
Zheng

(10) Patent No.: US 8,011,471 B2
(45) Date of Patent: Sep. 6, 2011

(54) EXHAUST CHAMBER FOR THE EXHAUST LINE OF AN AUTOMOBILE

(75) Inventor: Jian Zheng, Montbeliard (FR)

(73) Assignee: Faurecia Systemes d'Echappement, Nanterre (FR)

( * ) Notice: Subject to any disclaimer, the term of this patent is extended or adjusted under 35 U.S.C. 154(b) by 0 days.

(21) Appl. No.: 12/601,602

(22) PCT Filed: May 26, 2008

(86) PCT No.: PCT/FR2008/050906
§ 371 (c)(1),
(2), (4) Date: Apr. 6, 2010

(87) PCT Pub. No.: WO2008/149040
PCT Pub. Date: Dec. 11, 2008

(65) Prior Publication Data

US 2010/0193284 A1 Aug. 5, 2010

(30) Foreign Application Priority Data

May 25, 2007 (FR) ..... 07 55261

(51) Int. Cl.
*F01N 13/18* (2010.01)
*F01N 1/08* (2006.01)

(52) U.S. Cl. ..... 181/282; 181/265; 181/272; 181/276

(58) Field of Classification Search ..... 181/276, 181/282, 265, 272
See application file for complete search history.

(56) References Cited

U.S. PATENT DOCUMENTS

| | | | | | |
|---|---|---|---|---|---|
| 4,865,154 | A * | 9/1989 | Hanson et al. | ..... | 181/282 |
| 4,941,545 | A * | 7/1990 | Wilcox et al. | ..... | 181/282 |
| 5,187,334 | A * | 2/1993 | Abbott et al. | ..... | 181/265 |
| 5,229,557 | A * | 7/1993 | Allman et al. | ..... | 181/282 |
| 5,563,383 | A * | 10/1996 | Harwood | ..... | 181/282 |
| 5,563,385 | A * | 10/1996 | Harwood | ..... | 181/282 |
| 5,859,394 | A * | 1/1999 | Seehaus et al. | ..... | 181/282 |
| 6,257,367 | B1 * | 7/2001 | Allman | ..... | 181/282 |

FOREIGN PATENT DOCUMENTS

| | | |
|---|---|---|
| FR | 1268668 | 4/1961 |
| FR | 2878894 | 6/2006 |
| WO | 2006061489 | 6/2006 |

OTHER PUBLICATIONS

International Search Report dated Nov. 14, 2008, in PCT application.

* cited by examiner

*Primary Examiner* — Elvin G Enad
*Assistant Examiner* — Christina Russell
(74) *Attorney, Agent, or Firm* — Young & Thompson

(57) ABSTRACT

The exhaust chamber for a motor vehicle exhaust line includes: a main envelope defining a main enclosure and having an exhaust gas inlet and an exhaust gas outlet; and at least one saucer-shaped shell having an opening defined by a peripheral edge of the shell, the or each shell being tightly connected to an outside surface of the main envelope along the peripheral edge, the shell, with the main envelope, defining a secondary enclosure. The main envelope has, beneath the shell, a plurality of perforations for placing the main enclosure in communication with the secondary enclosure. The main envelope has, in a first area located beneath the shell, at least one slot for increasing the elasticity of the first area, and/or the main envelope has, in a second area that is not covered by the shell, at least one rib for increasing the stiffness of the second area.

20 Claims, 6 Drawing Sheets

EXHAUST CHAMBER FOR THE EXHAUST LINE OF AN AUTOMOBILE

CROSS-REFERENCE TO RELATED APPLICATIONS

The present Application claims priority to PCT/FR2008/050906 filed May 26, 2008 and French Application No. 0755261 May 25, 2007.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

The present invention relates generally to motor vehicle exhaust lines.

(2) Description of Related Art

More precisely, the invention relates to an exhaust chamber for a motor vehicle exhaust line, of the type comprising:

- a main envelope defining a main enclosure and having an exhaust gas inlet and an exhaust gas outlet, and
- at least one saucer-shaped shell having an opening defined by a peripheral edge of the shell, the or each shell being tightly connected to an outside surface of the main envelope along the peripheral edge, the shell, with the main envelope, defining a secondary enclosure, the main envelope having, beneath the shell, a plurality of perforations for placing the main enclosure in communication with the secondary enclosure.

Such an exhaust chamber is known from FR-04 13087, which further describes that the secondary enclosure is filled with a heat insulating material.

Because that exhaust chamber is thermally insulated in only some areas, namely the areas covered by the saucer-shaped shell, the different parts of the exhaust chamber exhibit heterogeneous thermomechanical behaviour. Under some extreme operating conditions, unacceptable deformations and cracks may appear in the exhaust chamber.

Within that context, the object of the invention is to propose an exhaust chamber having better thermomechanical behaviour.

BRIEF SUMMARY OF THE INVENTION

To that end, the invention relates to an exhaust chamber of the above-mentioned type, characterized in that the main envelope has, in a first area located beneath the shell, at least one slot for increasing the elasticity of said first area, and/or the main envelope has, in a second area that is not covered by the shell, at least one rib for increasing the stiffness of said second area.

The exhaust chamber can also exhibit one or more of the following features, considered individually or in all technically possible combinations:

- the main envelope comprises a rolled sleeve defining mutually opposite upstream and downstream openings, an upstream plate carrying the exhaust gas inlet and closing off the upstream opening, and a downstream plate carrying the exhaust gas outlet and closing off the downstream opening;
- a plurality of ribs are formed on the sleeve and extend parallel to a central axis of the sleeve;
- the or each rib has a height of from 1 to 10 millimeters;
- the or each slot extends in a plane perpendicular to a central axis (X) of the sleeve;
- the exhaust chamber has an internal tube which extends from the exhaust gas inlet to an end that opens into the main enclosure, at least one slot being formed in the sleeve substantially in alignment with the open end of the internal tube;
- between the inlet and the open end, the internal tube has lateral orifices which open into the main enclosure, at least one slot being formed in the sleeve substantially in alignment with the lateral orifices;
- the main envelope has a plurality of slots which are parallel to one another and are spaced at regular intervals from one another;
- the or each slot has a width of from 1 to 10 millimeters; and
- the or each slot is straight and extends across the greater part of the area of the main envelope that is covered by the shell.

BRIEF DESCRIPTION OF THE SEVERAL VIEWS OF THE DRAWINGS

Other features and advantages of the invention will become apparent from the detailed description thereof which is given below, by way of example and without implying any limitation, with reference to the accompanying drawings, in which.

DETAILED DESCRIPTION OF THE INVENTION

Figure 1:
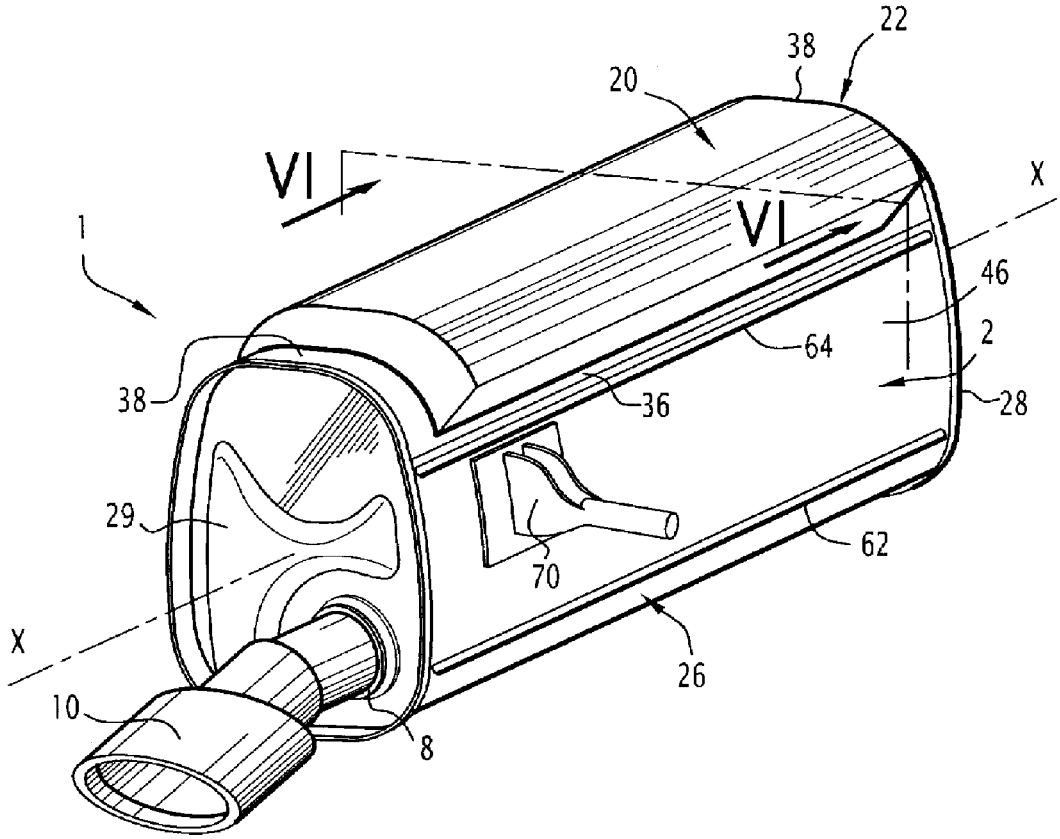
FIG. 1 is a three-quarter view, in perspective, of an exhaust silencer according to the invention.

The exhaust chamber 1 shown in FIG. 1 is an exhaust silencer which can be integrated into an exhaust line and is intended to muffle the noise annoyance caused by the pulsing of the exhaust gases circulating in the line.

Figure 2:
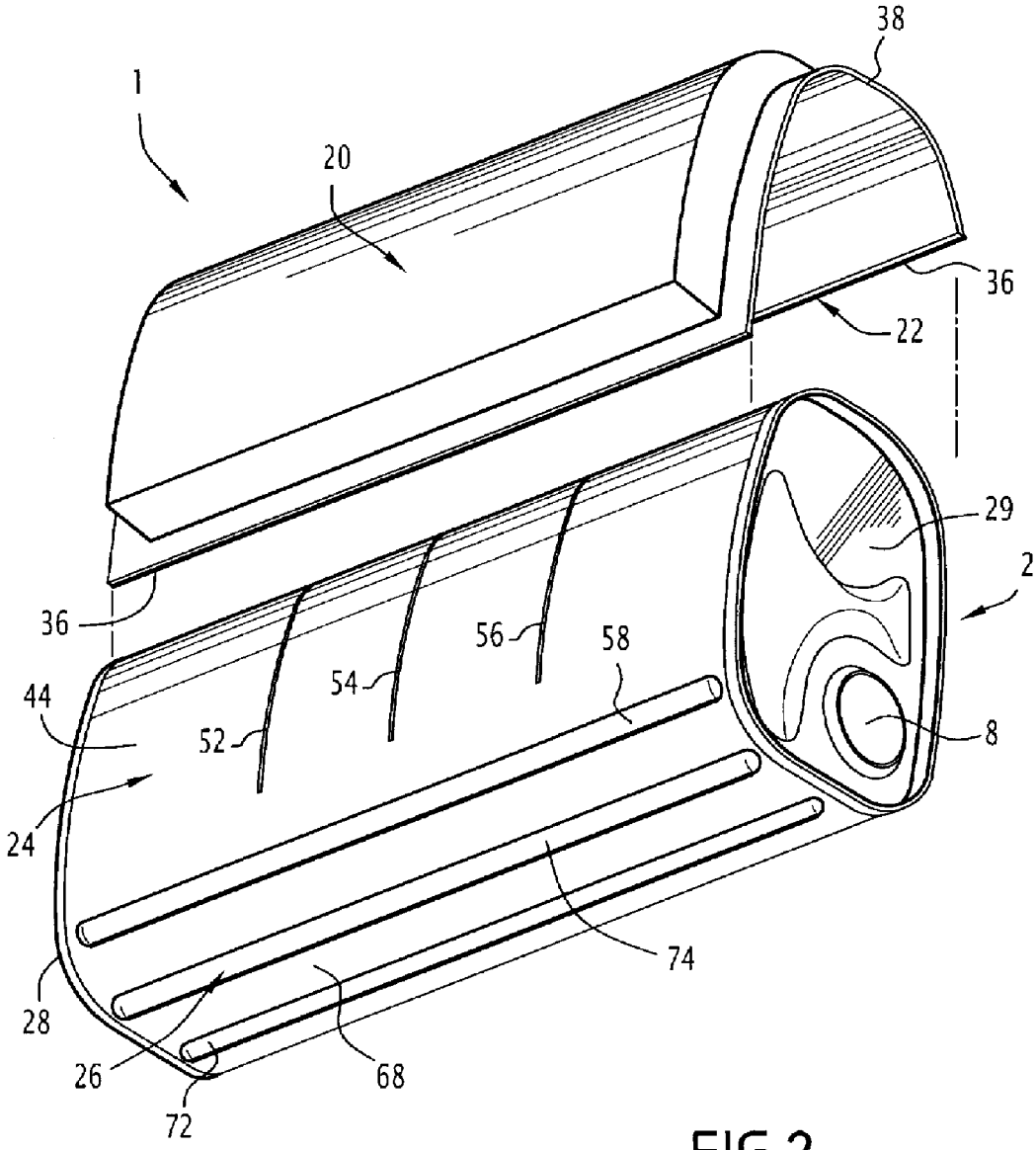
FIG. 2 is a perspective view of the silencer of FIG. 1 from a different angle, the shell defining the secondary enclosure being shown separated from the main envelope in order to reveal the slots formed in said main envelope.
Figure 4:
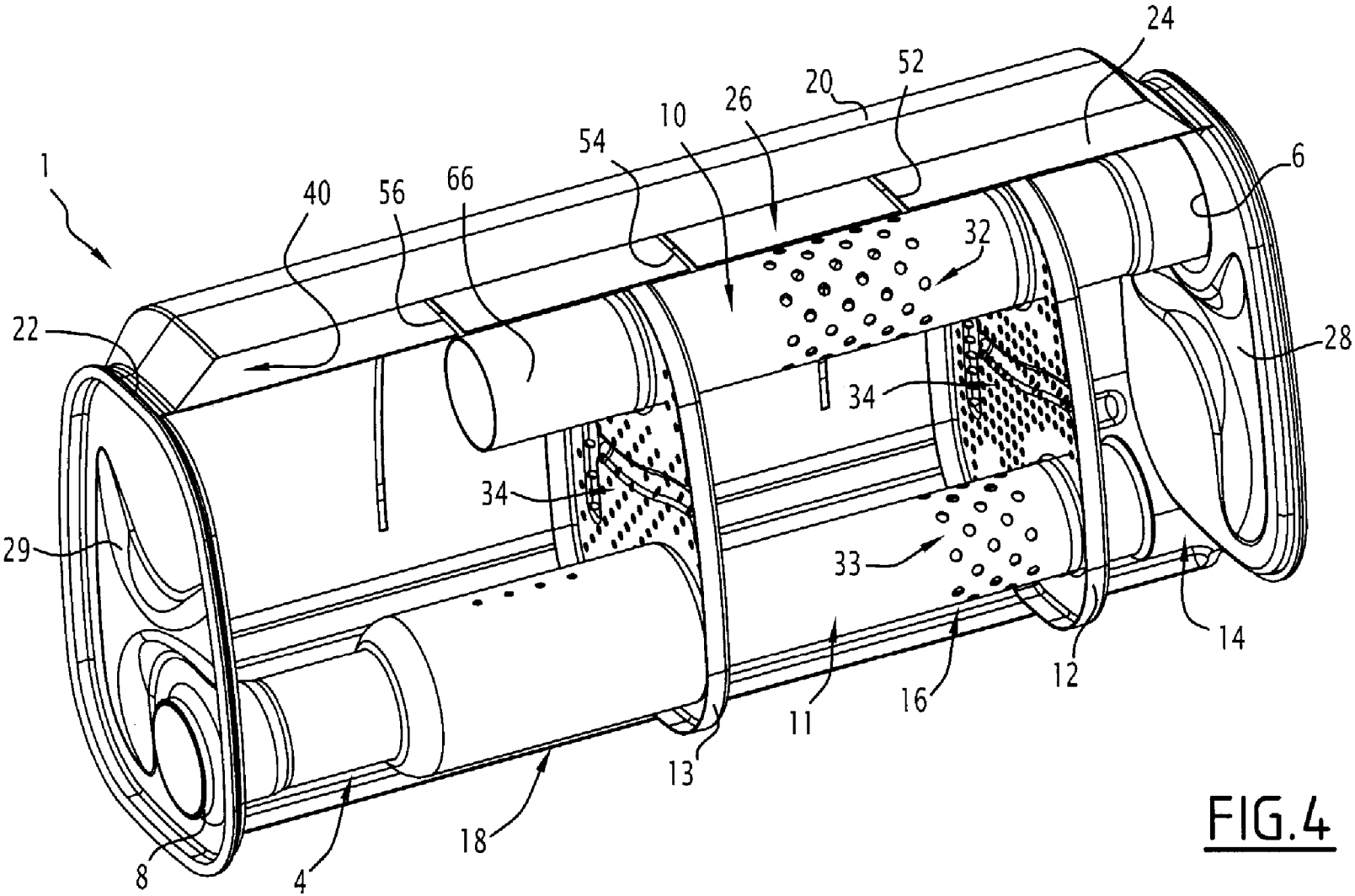
FIG. 4 is a view similar to that of FIG. 3, the main envelope being partly cut away in order to reveal the internal elements of the silencer.

The silencer 1 is of the type described in patent application FR-04 13087. It comprises, as shown in FIG. 4:

- a main envelope 2 defining a main enclosure 4 and having an exhaust gas inlet 6 and an exhaust gas outlet 8,
- an inlet tube 10 which is inserted through the inlet 6 and places the main enclosure 4 in communication with the upstream part of the exhaust line, and an outlet tube 11 which is inserted through the outlet 8 and places the main enclosure in communication with a downstream part of the exhaust line, two inner plates 12 and 13 which divide the main enclosure into three compartments 14, 16 and 18, a saucer-shaped shell 20 having an opening defined by a peripheral edge 22 of the shell, the shell 20 being fixed tightly to an outside surface 24 of the main envelope along the peripheral edge 22 (FIG. 2).

The main envelope 2 comprises a rolled sleeve 26 which defines mutually opposite upstream and downstream openings, an upstream plate 28 carrying the gas inlet 6 and closing off the upstream opening, and a downstream plate 29 carrying the exhaust gas outlet 8 and closing off the downstream opening. The sleeve 26 is composed of a generally rectangular sheet metal blank (FIG. 5) which is rolled up so as to bring the opposite longitudinal edges together. The longitudinal edges are joined together, in particular by crimping or welding, along a joining line 30 which extends along an outer surface of the enclosure (FIG. 6). The sleeve 26 is tubular in shape with a typically tapered cross-section with rounded corners, as is shown in FIGS. 1 to 6. The inner plates 12 and 13 extend substantially perpendicularly to the central axis X of the sleeve 26 (FIG. 4). They are substantially parallel to the upstream and downstream end plates 28 and 29. They extend over substantially the whole of the cross-section of the sleeve 26. The first compartment 14 extends between the upstream end plate 28 and the first plate 12, the second compartment 16 extends between the plates 12 and 13, and the third compartment 18 extends between the plate 13 and the downstream end plate 29.

The inlet tube 10 extends substantially parallel to the central axis X and passes, in succession, through the end plate 28, the compartment 14, the plate 12, the compartment 16 and the plate 13. The tube is connected at one end to the upstream part of the exhaust line and opens at its opposite end inside the compartment 18. As is shown in FIG. 4, it has small lateral orifices 32, which place the inside of the tube 10 in communication with the second compartment 16.

The outlet tube 11 is connected at one end to the downstream part of the exhaust line and opens at its opposite end into the first compartment 14. It extends substantially parallel to the central axis X. The tube passes, in succession, through the plate 12, the compartment 16, the plate 13, the compartment 18 and the downstream end plate 29. The tube 11 also has small lateral orifices 33, which place the inside of the tube 11 in communication with the compartment 16.

The plates 12 and 13 are additionally provided with a plurality of small orifices 34 which place the compartments in communication with one another. The inner plates 12 and 13 can also be provided with orifices of a larger size, some of which can be closed by valves which open selectively according to the pressure differences between the compartments 14, 16 and 18.

Figure 3:
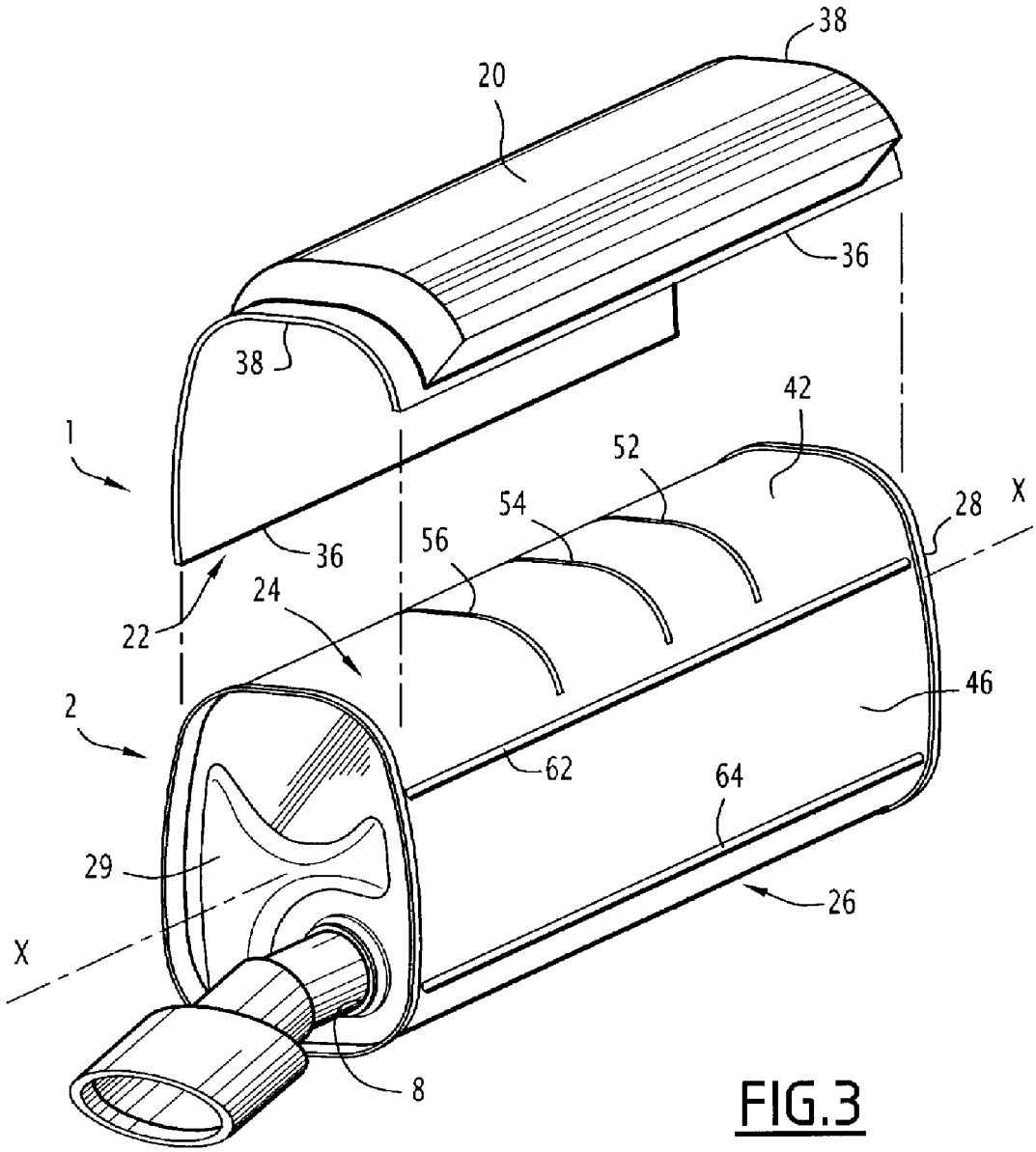
FIG. 3 is a perspective view of the silencer of FIG. 1 seen from a different angle.

The shell 20 is typically formed by an embossed sheet shaped by folding, pressing or swaging. As is shown in FIGS. 2 and 3, the peripheral edge 22, which is connected tightly to the main envelope 2, has two straight edges 36, which extend along outer surfaces of the sleeve 26, and two curved edges 38, which connect the straight edges 36 to one another. The curved edges 38 extend in planes perpendicular to the central axis X of the sleeve and are parallel to one another. They follow the shape of the cross-section of the sleeve.

The shell 20, with the main envelope 2, defines a secondary enclosure 40 (FIG. 6). The secondary enclosure is filled with a heat insulating material, for example glass fibres or ceramics fibres.

The shell 20 extends over the whole of the axial length of the sleeve 26. It covers the upper face 42 and the upper part of the left-hand lateral face 44 of the sleeve. Accordingly, the curved edges 38 are arranged immediately adjacent to the upstream and downstream plates 28 and 29. The straight edges 36 are arranged so that they cover the slots and perforations of the main envelope. One of the edges 36 is located, for example, at the top of the right-hand lateral face 46 and the other is located at the bottom of the left-hand lateral face 44 of the sleeve.

Beneath the shell 20, the sleeve 26 has a plurality of perforations 48 for placing the main enclosure 4 in communication with the secondary enclosure 40. These perforations are visible in FIG. 5. They are formed so that they are not located opposite the orifices 32 of the inlet tube 10. In addition, the holding areas 49 for the inner plates 12 and 13 do not have perforations.

The perforations 48 are grouped together in three separate areas 50, 50' and 50", which are separated from one another by unperforated strips which are substantially parallel to the curved edges 38. The area 50 is located between the plate 12 and the orifices 32 of the tube 10. The area 50' extends between the orifices 32 and the plate 13. The area 50" extends close to the plate 13, on the side of the compartment 18.

In order to improve the thermomechanical behaviour of the silencer, the main envelope has, in an area located beneath the shell 20, three slots 52, 54 and 56 and, in another area that is not covered by the shell 20, four ribs 58, 60, 62 and 64.

The slots 52, 54, 56 are parallel to one another and each extend in a plane perpendicular to the central axis X of the sleeve 26. They are spaced at regular intervals from one another. They extend across the greater part of the area of the sleeve 26 that is covered by the shell 20. Preferably, they extend virtually from one straight edge 36 to the other straight edge 36, their ends stopping substantially 20 mm to 50 mm from the edges 36.

Each slot has a width of from 1 mm to 10 mm, preferably from 3 mm to 5 mm.

Figure 5:
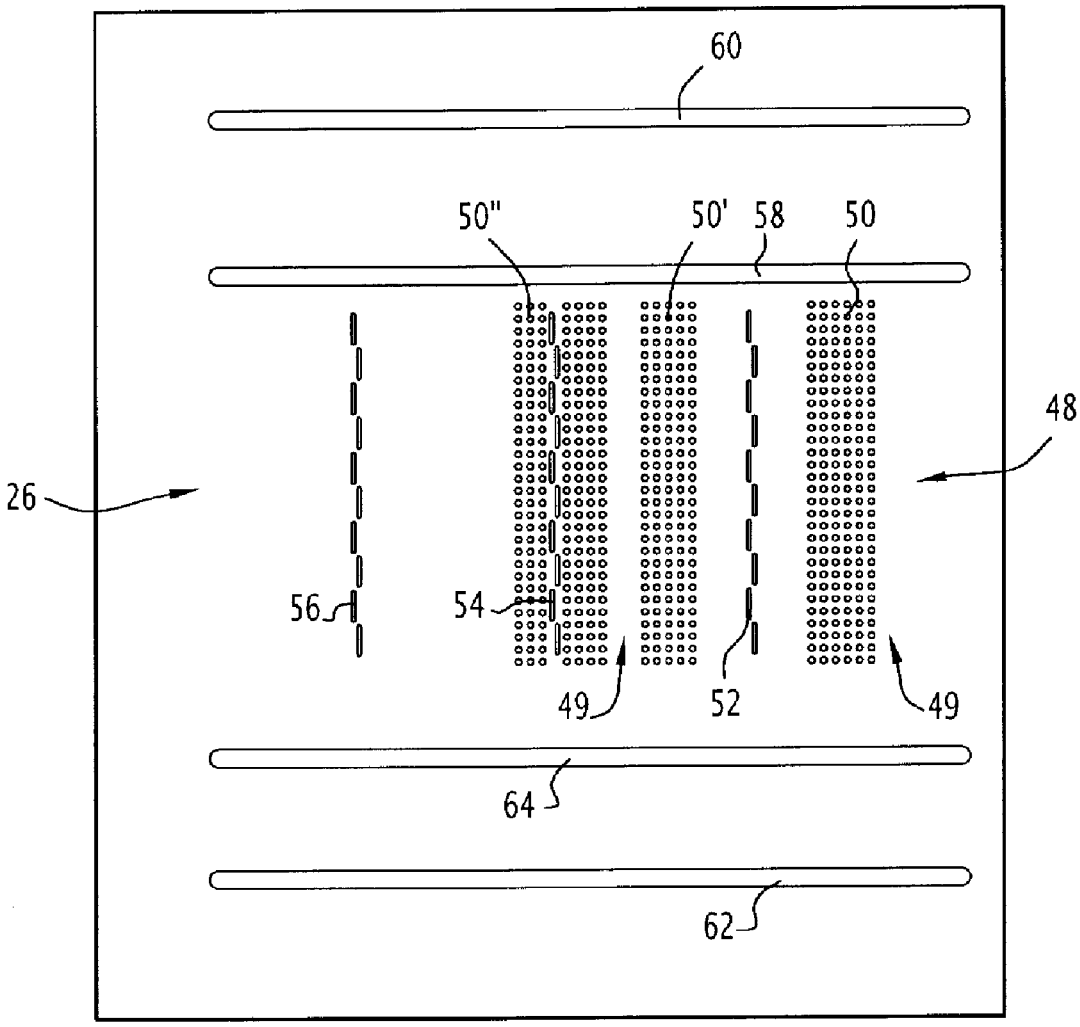
FIG. 5 is an opened-out view of the sleeve of the main enclosure.
Figure 6:
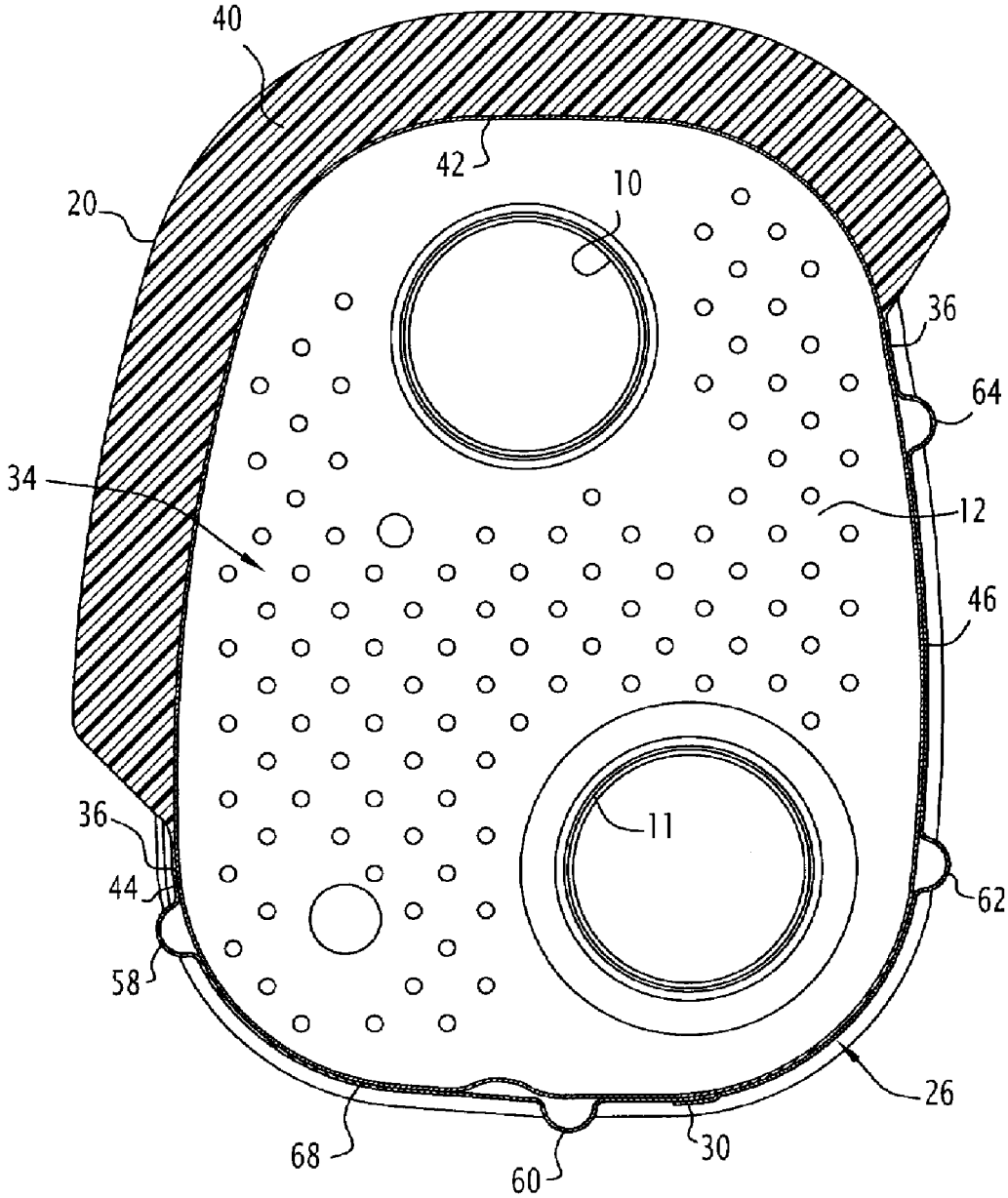
FIG. 6 is a transverse cutaway view of the silencer of FIG. 1, viewed according to the incidence of the arrows VI.

The slots 52, 54 and 56 can each be continuous or alternatively, as is shown in FIG. 5, they can be composed of discontinuous segments. The discontinuous segments can all be aligned as a continuation of one another or alternatively, as is shown in FIG. 5, they can be slightly offset axially so that the segments of one slot are arranged aligned in two lines parallel to one another and slightly offset axially from one another.

As will be seen in FIG. 4, the slot 56 is formed in the sleeve 26 substantially in alignment with the end 66 of the inlet tube that opens into the compartment 18. Located in alignment is understood as meaning that the slot 56 and the end 66 are located substantially in the same plane perpendicular to the central axis X of the sleeve.

The slot 54 is provided in the part of the sleeve 26 that defines the compartment 18. It extends close to the inner plate 13 but is slightly offset axially towards the downstream end tray 29 relative to the plate 12.

The slot 52 is provided in the part of the sleeve 26 that defines the compartment 16. It is arranged in alignment with the lateral orifices 32 of the inlet tube 10, placing the inside of the tube 10 in direct communication with the compartment 16.

Located in alignment is here understood as meaning that the slot 52 and the orifices 32 are located substantially at the same level axially.

The slot 52 is located between the perforated areas 50 and 50' of the sleeve 26. The slot 54 passes through the perforated area 50" and divides it into two parts.

The ribs 58, 60, 62 and 64 extend over substantially the whole of the longitudinal length of the silencer. They project towards the outside of the sleeve 26 and have a height of from 3 mm to 5 mm relative to the surface of the sleeve. They have a width of from 5 mm to 15 mm, preferably from 8 mm to 12 mm. The rib 64 is located on the right-hand lateral face 46 of the sleeve, immediately beneath the straight edge 36 of the shell (FIG. 6). The rib 62 is located substantially at the bottom of the face 46. The rib 58 is carried by the face 44 and is located immediately beneath the straight edge 36. The rib 60 is located substantially in the centre of the lower face 68 of the sleeve (FIG. 6). It is to be noted that the axial edges of the sleeve, referenced 30, which are crimped or welded together, are also located on the lower face 68 of the sleeve. They are located on the side of the right-hand lateral face 46 and extend between the rib 60 and the rib 62.

As is shown in FIG. 1, the silencer also has a bracket 70 for fixing the silencer to the motor vehicle, which bracket is fixed rigidly to the right-hand lateral face 46 of the sleeve between the ribs 62 and 64.

The exhaust chamber described above has many advantages.

The thermomechanical behaviour of the exhaust chamber is better because the main envelope has, in a first area located beneath the shell, at least one slot and/or, in a second area that is not covered by the shell, at least one rib. The slots enable the elasticity of the first area to be increased, and the ribs enable the stiffness of the second area to be increased.

The slots are advantageously arranged in the hottest areas of the main envelope, especially in alignment with the end through which the exhaust gas inlet conduit opens into the main enclosure, and in alignment with the small lateral orifices by which the inside of the inlet conduit communicates with the compartment 16.

The slots 52, 54 and 56 are spaced at regular intervals so that the behaviour of the exhaust chamber, from a thermomechanical point of view, is as homogeneous as possible. They are arranged across considerable temperature gradients.

The slots are arranged in the parts of the sleeve that are subjected to pronounced stress variations due to thermomechanical stress.

The slots are offset sufficiently with respect to the inner plates of the main envelope that they do not impair the fixing of the inner plates to the sleeve. The ends of the slots are also offset sufficiently from the peripheral edge of the shell so that they do not interfere with the fixing of said shell to the sleeve.

The fact that the slots are produced in the form of discontinuous segments has the advantage of presenting less of a hindrance to the fitting of the inner plates 12 and 13 inside the sleeve, as compared with the case where the slots are continuous.

The ribs 58, 60, 62 and 64 enable the areas of the main envelope that are not insulated to be stiffened. Two of the ribs are located close to the two straight edges of the shell welded to the sleeve, in order effectively to stiffen that area so as to limit weld separation.

The exhaust chamber can have many variants.

Accordingly, the main envelope can have only slots and no ribs or, alternatively, it can have only stiffening ribs and no slots.

The number of slots can be variable and can be less than or more than three. The number of ribs can likewise be variable and can be less than or more than four. Accordingly, as is shown in FIG. 2, the sleeve 26 can have two ribs 72 and 74 on its lower face 68 instead of the single rib 60 shown in FIG. 6.

It is possible for the sleeve to have a cross-section that is not tapered as is shown in FIGS. 1 to 6. It can have a round, parallelepipedal, oval or any type of cross-section.

It is possible for the main envelope not to be composed of a rolled sleeve and plates attached to the sleeve. For example, it can be composed of two dish-shaped half-shells fixed rigidly to one another. The sleeve, when it is rolled, can be closed by any means other than crimping or welding.

The upstream and downstream plates can likewise be replaced by convergent and divergent tubular profiles.

It is possible for the slots 52, 54 and 56 not to be parallel to one another. They can likewise not extend in planes perpendicular to the main axis of the sleeve. When the sleeve is opened out, they can have curved portions.

It is possible for the ribs 58, 60, 62 and 64 to extend not parallel to the central axis of the sleeve but obliquely. The ribs can be not parallel to one another. They can comprise curved portions.

The slots and ribs can be located, as required, in locations other than those shown in FIGS. 1 to 6 in order to soften or stiffen said locations.

It is possible for the exhaust chamber not to be a silencer. For example, it can comprise a particle filter and/or a catalyst inside the main enclosure.

The invention claimed is:

1. An exhaust chamber for a motor vehicle exhaust line, the exhaust chamber (1) comprising:

a main envelope (2) defining a main enclosure (4) and having an exhaust gas inlet (6) and an exhaust gas outlet (8), the main envelope (2) comprising a rolled sleeve (26) having a longitudinal central axis and defining mutually axially opposite upstream and downstream openings, said rolled sleeve being made of a single unitary sheet of metal rolled around the central axis, said sheet having two longitudinal edges joined together and secured to one another, the sleeve having a closed cross section perpendicularly to the central axis, and at least one saucer-shaped shell (20) having an opening defined by a peripheral edge (22) of the shell (20), the or each shell (20) being tightly connected to an outside surface (24) of the sleeve (26) of the main envelope (2) along the peripheral edge (22), the shell (20), with the sleeve (26), defining a secondary enclosure (40), the sleeve of the main envelope (2) having, beneath the shell (20), a plurality of perforations (48) for placing the main enclosure (4) in communication with the secondary enclosure (40), wherein the sleeve (26) of the main envelope (2) has, in a first area located beneath the shell (20), at least one slot (52, 54, 56) for increasing the elasticity of said first area, and/or the sleeve (26) the main envelope (2) has, in a second area that is not covered by the shell (20), at least one rib (58, 60, 62, 64, 72, 74) for increasing the stiffness of said second area.

2. The exhaust chamber according to claim 1, wherein the main envelope (2) has an upstream plate (28) carrying the exhaust gas inlet (6) and closing off the upstream opening of the sleeve (26), and a downstream plate (29) carrying the exhaust gas outlet (8) and closing off the downstream opening of the sleeve (26).

3. The exhaust chamber according to claim 2, wherein a plurality of ribs (58, 60, 62, 64, 72, 74) are formed on the sleeve (26) and extend parallel to the central axis (X) of the sleeve (26).

4. The exhaust chamber according to claim 2, wherein the or each rib (58, 60, 62, 64, 72, 74) has a height of from 1 to 10 millimeters.

5. The exhaust chamber according to claim 2, wherein the or each slot (52, 54, 56) extends in a plane perpendicular to the central axis (X) of the sleeve (26).

6. The exhaust chamber according to claim 2, further comprises an internal tube (10) which extends from the exhaust gas inlet (6) to an end (66) that opens into the main enclosure (4), at least one slot (56) being formed in the sleeve (26) substantially in alignment with the open end (66) of the internal tube (10).

7. The exhaust chamber according to claim 1, wherein a plurality of ribs (58, 60, 62, 64, 72, 74) are formed on the sleeve (26) and extend parallel to the central axis (X) of the sleeve (26).

8. The exhaust chamber according to claim 7, wherein the or each rib (58, 60, 62, 64, 72, 74) has a height of from 1 to 10 millimeters.

9. The exhaust chamber according to claim 7, wherein the or each slot (52, 54, 56) extends in a plane perpendicular to the central axis (X) of the sleeve (26).

10. The exhaust chamber according to claim 7, further comprises an internal tube (10) which extends from the exhaust gas inlet (6) to an end (66) that opens into the main enclosure (4), at least one slot (56) being formed in the sleeve (26) substantially in alignment with the open end (66) of the internal tube (10).

11. The exhaust chamber according to claim 1, characterized in that the or each rib (58, 60, 62, 64, 72, 74) has a height of from 1 to 10 millimeters.

12. The exhaust chamber according to claim 11, wherein the or each slot (52, 54, 56) extends in a plane perpendicular to the central axis (X) of the sleeve (26).

13. The exhaust chamber according to claim 11, further comprises an internal tube (10) which extends from the exhaust gas inlet (6) to an end (66) that opens into the main enclosure (4), at least one slot (56) being formed in the sleeve (26) substantially in alignment with the open end (66) of the internal tube (10).

14. The exhaust chamber according to claim 1, wherein the or each slot (52, 54, 56) has an elongated shape along a direction which extends in a plane perpendicular to the central axis (X) of the sleeve (26).

15. The exhaust chamber according to claim 14, further comprises an internal tube (10) which extends from the exhaust gas inlet (6) to an end (66) that opens into the main enclosure (4), at least one slot (56) being formed in the sleeve (26) substantially in alignment with the open end (66) of the internal tube (10).

16. The exhaust chamber according to claim 1, further comprises an internal tube (10) which extends from the exhaust gas inlet (6) to an end (66) that opens into the main enclosure (4), one of the at least one slot (56) being formed in the sleeve (26) substantially in alignment with the open end (66) of the internal tube (10) and placing the main enclosure (4) in communication with the secondary enclosure (4).

17. The exhaust chamber according to claim 16, wherein the internal tube (10) has, between the inlet (6) and the open end (66), lateral orifices (32) which open into the main enclosure (4), one of the at least one slot (52) being formed in the sleeve (26) substantially in alignment with the lateral orifices (32) and placing the main enclosure (4) in communication with the secondary enclosure (4).

18. The exhaust chamber according to claim 1, wherein the main envelope (2) has a plurality of slots (52, 54, 56) which are parallel to one another and are spaced at regular intervals from one another.

19. The exhaust chamber according to claim 1, wherein the or each slot (52, 54, 56) has a width of from 1 to 10 millimeters.

20. The exhaust chamber according to claim 1, wherein the or each slot (52, 54, 56) is straight and extends across the greater part of the area of the main envelope (2) that is covered by the shell (20).

* * * * *